US009302489B2

(12) United States Patent
Sugimoto et al.

(10) Patent No.: US 9,302,489 B2
(45) Date of Patent: Apr. 5, 2016

(54) LIQUID DISCHARGE RECORDING APPARATUS AND METHOD FOR RECOVERING LIQUID

(71) Applicants: Junichiro Sugimoto, Nagoya (JP); Noriaki Satoh, Nagoya (JP); Ayako Ohishi, Nagoya (JP); Akihiko Taniguchi, Kakamigahara (JP)

(72) Inventors: Junichiro Sugimoto, Nagoya (JP); Noriaki Satoh, Nagoya (JP); Ayako Ohishi, Nagoya (JP); Akihiko Taniguchi, Kakamigahara (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 110 days.

(21) Appl. No.: 14/228,386

(22) Filed: Mar. 28, 2014

(65) Prior Publication Data

US 2014/0292964 A1 Oct. 2, 2014

(30) Foreign Application Priority Data

Mar. 29, 2013 (JP) ..... 2013-073974
Mar. 29, 2013 (JP) ..... 2013-074464

(51) Int. Cl.

| | |
|---|---|
| ***B41J 2/185*** | (2006.01) |
| ***B41J 2/165*** | (2006.01) |
| ***B41J 2/17*** | (2006.01) |

(52) U.S. Cl.
CPC ..... *B41J 2/185* (2013.01); *B41J 2/1714* (2013.01)

(58) Field of Classification Search
CPC ..... B41J 2002/1742; B41J 2/1751; B41J 2/1714; B41J 2/185; B41J 2002/1856; B41J 2/165; B41J 2/16523
USPC ..... 347/90, 31
See application file for complete search history.

(56) References Cited

U.S. PATENT DOCUMENTS

2007/0273725 A1* 11/2007 Furukawa ..... B41J 2/1721 347/36

FOREIGN PATENT DOCUMENTS

| | | | | |
|---|---|---|---|---|
| JP | 2003-128969 | A | | 5/2003 |
| JP | 2003-147243 | A | | 5/2003 |
| JP | 2004-155182 | A | | 6/2004 |
| JP | 2004-284171 | A | | 10/2004 |
| JP | 2005-074889 | A | | 3/2005 |
| JP | 2005074889 | A | * | 3/2005 |
| JP | 2006-247852 | A | | 9/2006 |

* cited by examiner

*Primary Examiner* — Jannelle M Lebron
(74) *Attorney, Agent, or Firm* — Banner & Witcoff, Ltd.

(57) ABSTRACT

A liquid discharge recording apparatus includes: a liquid; a liquid discharge head configured to discharge the liquid; an absorber configured to absorb the liquid discharged from the liquid discharge head; and unsaturated fatty acid of which specific gravity is smaller than that of the liquid and which is contained in the absorber.

21 Claims, 3 Drawing Sheets

LIQUID DISCHARGE RECORDING APPARATUS AND METHOD FOR RECOVERING LIQUID

CROSS REFERENCE TO RELATED APPLICATION

The present application claims priorities from Japanese Patent Applications No. 2013-074464 filed on Mar. 29, 2013 and No. 2013-073974 filed on Mar. 29, 2013, the disclosures of which are incorporated herein by reference in their entireties.

BACKGROUND OF THE INVENTION

1. Field of the Invention

The present invention relates to a liquid discharge recording apparatus and a method for recovering a liquid.

2. Description of the Related Art

Conventionally, a water-based ink for ink-jet recording (hereinafter referred to as a "water-based ink" or an "ink" in some cases) has been using, as a solvent, a volatile organic solvent (see, for example, Japanese Patent Application Laid-open No. 2003-147243). In the recent years, however, there is a demand for the water-based ink to lower the generation of any VOC (Volatile Organic Compounds), in view of protection of the global environment. For this purpose, there are proposed measurement such as lowering a content of the volatile organic solvent in the water-based ink, using a soluble organic solvent which is non-volatile with respect to the water-based ink, etc., so as to lower the generation of the VOC (see, for example, Japanese Patent Application Laid-open No. 2003-128969).

In the recent years, there is an increased demand for further lowering the generation of VOC as the consumption of ink is increased due to the improvement in recording speed. On the other hand, in a case that a non-volatile organic solvent is added to a water-based ink as the countermeasure against the VOC, the quick-drying property during recording and the spreading into a recording medium such as a recording paper (recording sheet), etc., are not sufficient, making it difficult to satisfy the property or performance as a water-based ink adapted for a high-speed recording. In view of the situation described above, there is a demand for a liquid discharge recording apparatus, such as an ink-jet recording apparatus, which is adapted to the high-speed recording as well as capable of further lowering the generation of VOC more than the conventional technique.

An object of the present teaching is to provide a liquid discharge recording apparatus and a method for recovering a liquid which are capable of lowering the generation of VOC.

SUMMARY OF THE INVENTION

According to a first aspect of the present teaching, there is provided a liquid discharge recording apparatus including: a liquid; a liquid discharge head configured to discharge the liquid; an absorber configured to absorb the liquid discharged from the liquid discharge head; and unsaturated fatty acid of which specific gravity is smaller than that of the liquid and which is contained in the absorber.

According to a second aspect of the present teaching, there is provided a liquid-recovery method for recovering a liquid in a liquid discharge recording apparatus, the method including: discharging the liquid from a liquid discharge head of the liquid discharge recording apparatus; and recovering the liquid, discharged from the liquid discharge head, by absorbing the liquid with an absorber containing unsaturated fatty acid of which specific gravity is smaller than that of the liquid.

DESCRIPTION OF THE PREFERRED EMBODIMENTS

First Embodiment

Figure 1:
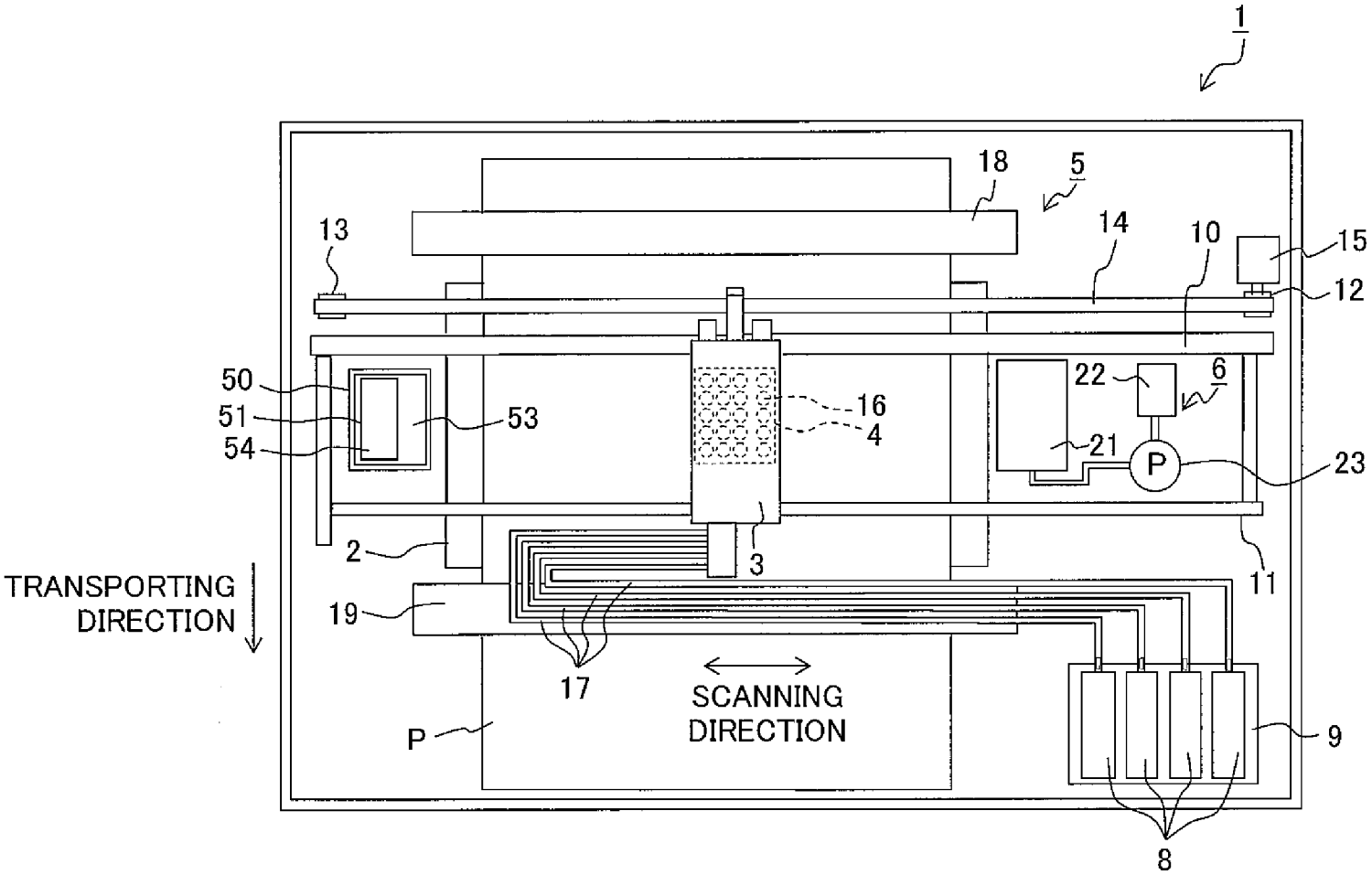
FIG. 1 is a schematic plane view showing the configuration of an example of a liquid discharge recording apparatus according to first and second embodiments of the present teaching.

As a first embodiment of the present teaching, an explanation will be given about a liquid discharge recording apparatus including a liquid; a liquid discharge head which discharges the liquid; an absorber which absorbs the liquid from (discharged from) the liquid discharge head; and unsaturated fatty acid of which specific gravity is smaller than that of the liquid and which is contained in the absorber.

The liquid usable in the liquid discharge recording apparatus of the first embodiment includes, for example, a water-based ink for ink-jet recording, a treatment solution (treatment liquid) used in the ink-jet recording, etc. The treatment liquid is a liquid which is discharged to a recording medium before or after the discharge of ink, for the purpose of improving the image quality, etc. Further, the liquid is not limited to a liquid to be used for ink-jet recording, and is exemplified by, for example, a preservative liquid (shipping liquid), an introductory liquid, an inspection liquid, etc. The preservative liquid is a liquid charged into a flow channel, of a liquid discharge recording apparatus, in a state of shipped out from the factory so as to preserve that state inside the flow channel. The preservative liquid also functions as follows: after the liquid discharge recording apparatus has been shipped from the factory and when a user introduces an ink to the flow channel of the liquid discharge recording apparatus, the preservative liquid functions to promote the introduction of the ink into the flow channel. The introductory liquid is a liquid which is charged in advance into the flow channel of the liquid discharge recording apparatus after a liquid discharge head of the apparatus has been produced such that, when the ink is introduced into the flow channel in the factory, the ink is easily introduced into the flow channel. The inspection liquid is a liquid to be used for inspecting the discharge of the liquid discharge head in the factory.

The first embodiment is based on a concept to lower the volatilization of the VOC contained in the liquid by allowing the absorber to contain unsaturated fatty acid of which specific gravity is smaller than that of the liquid to thereby cover or cap the liquid, permeated into the absorber, with an oil film of the unsaturated fatty acid. The inventors of the present teaching were the first to obtain this concept. Base on the concept, the inventors of the present teaching found out that the volatilization of the VOC contained in the liquid can be actually lowered by discharging the liquid from the liquid discharge head to the absorber containing the unsaturated fatty acid of which specific gravity is smaller than that of the liquid. Further, the unsaturated fatty acid used in the embodiment forms the oil film more easily than saturated fatty acid. Thus, according to the first embodiment, it is possible to provide a liquid discharge recording apparatus and a liquid recovery method which are capable of lowering the volatilization of VOC.

Further, according to the first embodiment, the secondary effect as described below can be also obtained. The liquid of which specific gravity is greater than the specific gravity of the unsaturated fatty acid permeates below the unsaturated fatty acid in the absorber. Accordingly, for example, in such a case that the absorber is a flushing absorber of the liquid discharge recording apparatus, as will be described later on, the liquid is prevented from accumulating in (on) the surface of the absorber, thereby suppressing any mixing of the liquid in a liquid discharge surface of a liquid discharge head, suppressing any clogging of the liquid discharge head which would be otherwise caused by the liquid accumulated on a surface of the absorber and brought into contact with the liquid discharge head. Further, any staining (contamination) of a recording medium such as recording paper (recording sheet), etc., which would be otherwise caused by the liquid accumulated on a surface of the absorber and brought into contact with the recording medium, is also suppressed. The unsaturated fatty acid used in the embodiment is highly effective in suppressing the accumulation of the liquid on the surface of the absorber, as compared with the saturated fatty acid.

In the liquid discharge recording apparatus of the first embodiment, the unsaturated fatty acid may be appropriately selected depending on the specific gravity of the liquid. Although the degree of unsaturation of the unsaturated fatty acid is not specifically limited, the degree of unsaturation is preferably 1 to 3. By making the degree of unsaturation be within the range of 1 to 3, it is possible to further enhance the effect of lowering the volatilization of the VOC contained in the liquid and the effect of suppressing the accumulation of the liquid on the surface of the absorber. Further, although the specific gravity of the unsaturated fatty acid is not specifically limited provided that the specific gravity of the unsaturated fatty acid is smaller than the specific gravity of the liquid, the specific gravity of the unsaturated fatty acid is preferably in a range of 0.850 to 0.915. By making the degree of specific gravity of the unsaturated fatty acid be within the range of 0.850 to 0.915, it is possible to further enhance the effect of lowering the volatilization of the VOC contained in the liquid and the effect of suppressing the accumulation of the liquid on the surface of the absorber. Specific examples of the unsaturated fatty acid include, for example, erucic acid (degree of unsaturation: 1, specific gravity: 0.880), oleic acid (degree of unsaturation: 1, specific gravity: 0.898), linoleic acid (degree of unsaturation: 2, specific gravity: 0.902), linolenic acid (degree of unsaturation: 3, specific gravity: 0.914), arachidonic acid (degree of unsaturation: 4, specific gravity: 0.919), etc.

In a case that the liquid is a water-based ink, difference between specific gravity of the water-based ink and that of the unsaturated fatty acid may be in a range of 0.151 to 0.21.

In the liquid discharge recording apparatus of the first embodiment, the absorber may contain another liquid, in addition to the unsaturated fatty acid, the another liquid including a lipophilic solvent, etc., in a range not adversely affecting the effect of the embodiment, or may not contain such another liquid. In a case that the absorber contains another liquid in addition to the unsaturated fatty acid, the ratio of the unsaturated fatty acid to the total amount of the liquid contained in the absorber is preferably in a range of 20% by weight to 100% by weight, is more preferably in a range of 50% by weight to 100% by weight. In view of the above-described effect obtained by the unsaturated fatty acid, the absorber preferably contains substantially only the unsaturated fatty acid. For example, the ratio of the unsaturated fatty acid to the total amount of the liquid contained in the absorber is preferably in a range of 99% by weight to 100% by weight.

In the liquid discharge recording apparatus of the first embodiment, the absorber which absorbs the liquid discharged from the liquid discharge head may be any absorber provided that the absorber is capable of absorbing the liquid. For example, the absorber is exemplified by melamine foam, urethane foam, polyethylene foam, silicone foam, acrylic foam, chloroprene rubber (CR) sponge, natural rubber (NR) sponge, nitrile rubber (NBR) sponge, ethylene propylene diene rubber (EPDM) sponge, felt foam, needle felt among which melamine foam is preferable.

In view of preventing the liquid from dripping or leaking from the absorber, the amount of the unsaturated fatty acid contained per 1 $mm^3$ of the absorber is preferably not more than 0.91 $\mu g/mm^3$, and is more preferably not more than 0.7 $\mu g/mm^3$. Further, in view of sufficiently suppressing the volatilization of the liquid, the amount of the unsaturated fatty acid contained per 1 $mm^3$ of the absorber is preferably not less than 0.1 $\mu g/mm^3$, and is more preferably not less than 0.2 $\mu g/mm^3$. Furthermore, the amount of the unsaturated fatty acid contained in the absorber may be determined depending on, for example, the period of service life or lifetime of the liquid discharge recording apparatus, etc. For example, in a case that the absorber is a flushing absorber (to be described later on) of the liquid discharge recording apparatus, the amount of the unsaturated fatty acid contained in the flushing absorber is preferably not less than 0.10 g, is more preferably not less than 0.18 g, is preferably not more than 0.81 g, and is more preferably not more than 0.63 g.

The specific gravity of the liquid is not particularly limited provided that the specific gravity of the liquid is greater than the specific gravity of the unsaturated fatty acid. It is preferable, however, that the specific gravity of the liquid is in a range of 0.95 to 1.30, and is more preferably in a range of 1.00 to 1.20.

In a case that the liquid is a water-based ink, the water-based ink contains a colorant, water and a water-soluble organic solvent. Although the colorant may be at least one of a dye and a pigment, the colorant is preferably a pigment. Further, the water-based ink may contain, as the colorant, substantially only a pigment, without containing any dye. In a case that the colorant is a pigment, there is a fear that when the water-based ink is discharged onto the surface of the absorber, the pigment might accumulate onto the surface of the absorber. However, the liquid discharge recording apparatus of the embodiment is capable of suppressing any accumulation of pigment on the surface of the absorber. The blending amount of the colorant with respect to the entire amount of the water-based ink is not particularly limited, and may be appropriately determined based on, for example, desired optical density or color (hue, tint), etc. The blending amount of the colorant is, for example, 0.2% by weight to 20% by weight, and is preferably 2% by weight to 10% by weight.

It is preferable that the water contained in the water-based ink is ion exchange water or pure water (purified water). The blending amount of water (water ratio) with respect to the entire amount of the water-based ink is, for example, 10% by weight to 90% by weight, and preferably 40% by weight to 80% by weight. The water ratio may be, for example, the balance of the other components.

The water-soluble organic solvent is exemplified, for example, by a humectant which prevents the water-based ink from being dried at an end portion (forward end portion) of a nozzle of an ink-jet head and/or a penetrant which adjusts the drying velocity on a recording medium. The blending amount of the humectant (humectant ratio) with respect to the entire amount of the water-based ink is, for example, in a range of 0% by weight to 95% by weight, is preferably in a range of 5% by weight to 80% by weight, and is more preferably in a range of 5% by weight to 50% by weight. It is particularly preferable that glycerol is contained, as the humectant, in an amount in a range of 5% by weight to 40% by weight, and more preferably in a range of 10% by weight to 30% by weight. The blending amount of the penetrant (penetrant ratio) with respect to the entire amount of the water-based ink is preferably in a range of 0% by weight to 20% by weight. By making the penetrant ratio fall within the above-described range, the penetrating ability of the water-based ink into the recording medium can be made more suitable. The penetrant ratio is preferably in a range of 0.1% by weight to 15% by weight, and more preferably in a range of 0.5% by weight to 10% by weight.

The water-based ink may further contain any other conventionally known additive(s) exemplified by surfactants, pH-adjusting agents, viscosity-adjusting agents, surface tension-adjusting agents, fungicides, etc., as necessary.

The water-based ink can be prepared, for example, such that the colorant, water, the water-soluble organic solvent and optionally other additive component(s) are mixed uniformly or homogeneously by any conventionally known method, and undissolved matters are removed by a filter or the like.

In a case that the liquid is a preservative liquid (shipping liquid), the preservative liquid may have a composition similar to that of the water-based ink, except for the blending amount of the colorant, and the preservative liquid may be prepared in a method similar to the method for preparing the water-based ink. The preservative liquid is a liquid to be charged in a flow channel of the liquid discharge recording apparatus so as to maintain the state of the flow channel. Therefore, it is allowable that the preservative liquid does not contain any colorant, or that the preservative liquid contains a colorant so that the presence of the preservative liquid can be visually confirmed. In a case that the preservative liquid contains a colorant, the blending amount of the colorant in the preservative liquid is preferably not more than 0.5% by weight.

Next, a liquid discharge recording apparatus and a liquid recovery method of the first embodiment will be specifically explained. The liquid discharge recording apparatus of the first embodiment includes a liquid discharge head which discharges a liquid and an absorber which absorbs the liquid discharged from the liquid discharge head. The absorber is preferably at least one of a flushing absorber and a waste liquid absorber. In the liquid discharge recording apparatus of the first embodiment, the configuration of the liquid discharge recording apparatus, except for the absorber, may be similar to that of a conventional liquid discharge recording apparatus such as an ink-jet recording apparatus. The liquid recovery method of the first embodiment is practiced by using the liquid discharge recording apparatus of the first embodiment.

FIG. 1 shows the configuration of an example of the liquid discharge recording apparatus of the first embodiment. As shown in FIG. 1, a liquid discharge recording apparatus 1 of the first embodiment includes a platen 2, a carriage 3, an ink-jet head (liquid discharge head) 4, a transporting mechanism 5 and a maintenance unit 6 as main constitutive components or parts.

A recording medium (for example, recording paper or recording sheet) P supplied from a paper feeding mechanism (not shown in the drawings) is placed on the upper surface of the platen 2. Two guide rails 10 and 11 are arranged at a position above or over the platen 2, and extend parallel to each other in the scanning direction (left/right direction in FIG. 1). The carriage 3 is movable in a reciprocating manner in the scanning direction along the two guide rails 10 and 11 in an area at which the carriage 3 faces or is opposite to the platen 2.

The two guide rails 10 and 11 extend in the scanning direction to further protrude from the left and right ends of the platen 2. The carriage 3 is configured to be movable from the area facing the recording paper P on the platen 2 (recording area) to positions located away from both of the left/right ends of the platen 2 (non-recording areas). An endless belt 14 wound between two pulleys 12 and 13 is connected to the carriage 3. By driving the endless belt 14 to run by a carriage driving motor 15, the carriage 3 is reciprocated in the scanning direction, accompanying with the running of the endless belt 14.

The ink-jet head 4 is installed in a lower portion of the carriage 3. The lower surface of the ink-jet head 4 is a liquid discharge surface 4*a* (see FIG. 2) which is parallel to the upper surface of the platen 2 and in which a plurality of nozzles 16 are opened. The liquid is discharged from the plurality of nozzles 16 of the liquid discharge surface 4*a* onto the recording paper P placed on the platen 2 so as to perform recording on the recording paper P.

Four ink supply ports (not shown in the drawings) corresponding to colors of black, yellow, cyan and magenta, respectively are provided on the upper surface of the ink-jet head 4, and one ends of four tubes 17 are connected to the four ink supply ports, respectively. The other ends of the four tubes 17 are connected to a cartridge installation section 9 that is configured such that four ink cartridges 8 storing the four color inks respectively are detachably attached to the cartridge installation section 9. With this configuration, the inks of the respective four colors are supplied to the ink-jet head 4 from the four ink cartridges 8, installed in the cartridge installation section 9, via the four tubes 17, respectively.

The transporting mechanism 5 has two transporting rollers 18 and 19 which are arranged so as to sandwich the platen 2 therebetween in a transporting direction (direction from the upper portion to the lower portion in FIG. 1). The recording paper P placed on the platen 2 is transported in the transporting direction by the two transporting rollers 18 and 19.

The liquid discharge recording apparatus 1 discharges the liquid from the ink-jet head 4 installed in the carriage 3 toward the recording paper P placed on the platen 2 and transports the recording paper P in the transporting direction by the two transporting rollers 18 and 19, thereby printing desired image and/or letter, etc., on the recording paper P.

Next, the maintenance unit 6 will be explained. The maintenance unit 6 includes a purge unit and a flushing unit. The purge unit has a waste liquid absorber 22, a suction cap 21 and a suction pump 23 which are arranged on one side in the scanning direction (on the right side in FIG. 1) with respect to the platen 2. The flushing unit is arranged on the other side in the scanning direction (on the left side in FIG. 1) with respect to the platen 2, and includes a first flushing absorber 53, a second flushing absorber 54, a waste liquid tank 50 and a liquid receiving member 51, as main constitutive components or parts.

The suction cap 21 is driven by a cap driving mechanism including a driving mechanism such as a motor (not shown) so that the suction cap 21 is moved in the up and down direction and makes approach/separation with respect to the liquid discharge surface 4*a*. The suction pump 23 is connected to the suction cap 21. When the suction cap 21 makes contact with the liquid discharge surface 4*a*, the suction cap 21 covers the openings of the plurality of nozzles 16. In a case that the suction cap 21 is in a capping state in such a manner, the suction pump 23 is driven to perform suction and depressurization in the inside of the suction cap 21, thereby causing the liquid to be discharged from all of the nozzles 16 covered by the suction cap 21 (suction purge). The suction pump 23 is connected to the waste liquid absorber 22. The liquid which is sucked and discharged or outgoing from the nozzles 16 is absorbed by the waste liquid absorber 22 via the suction pump 23. Although not shown in the drawings, the waste liquid absorber 22 is accommodated in a box which is open at an upper portion of the box. The waste liquid absorber 22 may be any member provided that such a member is capable of absorbing a liquid, such as, for example, a melamine foam, etc.

Figure 2:
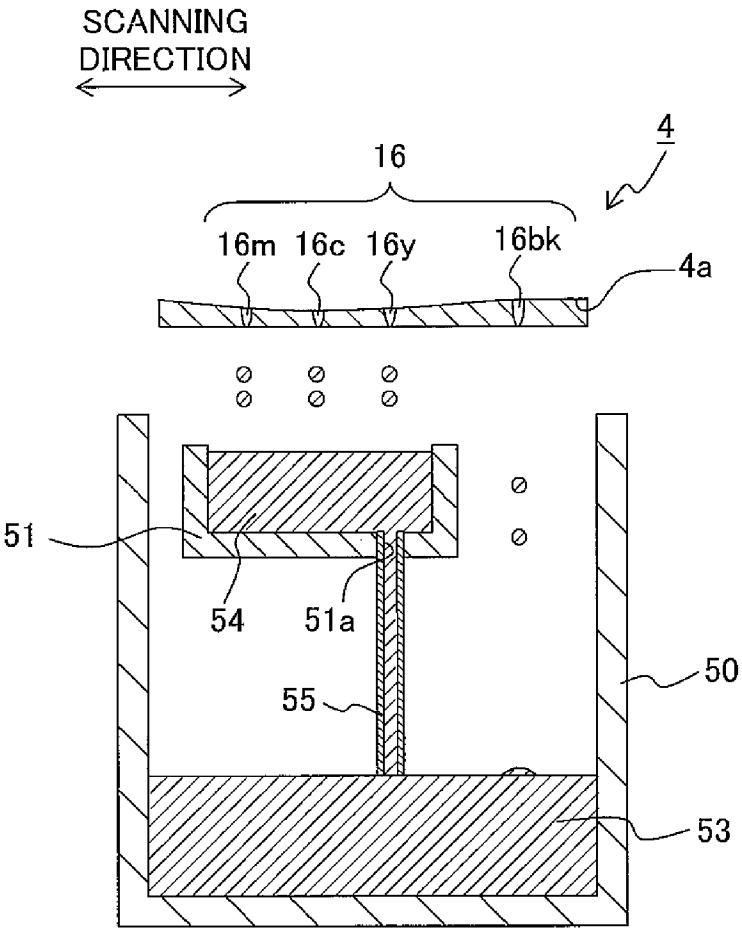
FIG. 2 is a cross-sectional view of a waste liquid tank in a vertical plane including a scanning direction when the liquid discharge recording apparatus of the first embodiment, which is shown in FIG. 1, performs a liquid recovery operation.

As shown in FIG. 2, the waste liquid tank 50 has a box-shape which is open at an upper portion thereof, and accommodates the first flushing absorber 53 inside of the waste liquid tank 50. The liquid receiving member 51 is arranged at a position above or over the first flushing absorber 53. The liquid receiving member 51 has a box-shape which is open at an upper portion thereof, and accommodates the second flushing absorber 54 inside of the liquid receiving member 51. A discharge port 51*a* is formed in the liquid receiving member 51 at a portion on the bottom surface and located on one side in the scanning direction (on the right side in FIG. 2). The discharge port 51*a* is connected to the other end of a tube 55 of which one end makes contact with the upper surface of the first flushing absorber 53. With this, the liquid sucked to the upper surface of the second flushing absorber 54 moves downwardly and is discharged from the discharge port 51*a* to the first flushing absorber 53, via the tube 55. Each of the first and second flushing absorbers 53 and 54 may be any member provided that such a member is capable of absorbing a liquid, such as, for example, a melamine foam, etc. Note that in the embodiment, the purge unit is configured to suck the liquid from the nozzles 16 by the suction pump 23. However, the purge unit may be configured as a so-called "push purge" mechanism which applies pressure to the liquid inside the ink-jet head 4 to thereby cause the liquid to be discharged from the nozzles 16. Namely, the liquid to be absorbed by the absorber in the first embodiment may be a liquid which is discharged actively from the nozzles, or a liquid which is discharged forcibly from the nozzles as in the suction purge. Alternatively, it is allowable to provide such an aspect wherein the absorber receives the liquid discharged directly to the absorber, or another aspect wherein the absorber receives the liquid indirectly, e.g. a liquid fed from the suction pump, etc. to the absorber.

The first flushing absorber 53, the second flushing absorber 54 and the waste liquid absorber 22 contain unsaturated fatty acid of which specific gravity is smaller than that of the liquid. In each of the first and second flushing absorbers 53 and 54, the unsaturated fatty acid may be contained only at a portion which makes contact with the liquid discharged from the ink-jet head 4, or may be contained in the entirety of each of the first and second flushing absorbers 53 and 54.

Each of the first flushing absorber 53, the second flushing absorber 54 and the waste liquid absorber 22 may further contain a lipophilic solvent at an amount that does not adversely affect the effect of the present teaching. The lipophilic solvent includes, for example, ethylene glycol diacetate, sorbitan trioleate, sorbitan sesquoleate, etc. The volume ratio (X:Y) of the blending amount of the unsaturated fatty acid (X) to the blending amount of the lipophilic solvent (Y) preferably satisfy that the volume ratio (X:Y) is in a range of X:Y=2:1 to X:Y=1000:1, more preferably is in a range of X:Y=4:1 to X:Y=1000:1, and further more preferably is in a range of X:Y=10:1 to X:Y=1000:1.

Next, an example of the liquid recovery method of the first embodiment will be explained with reference to FIG. 2. This example is a liquid recovery method wherein the liquid from the ink-jet head 4 is recovered by discharging the liquid from the ink-jet head 4 directly to the flushing absorber. FIG. 2 is a cross-sectional view of the waste liquid tank 50 in a vertical plane including the scanning direction when the liquid discharge recording apparatus 1 shown in FIG. 1 performs a liquid recovery operation. In FIG. 2, reference numerals "16*bk*", "16*y*", "16*c*" and "16*c*" indicate nozzles 16 for the black, yellow, cyan and magenta inks, respectively. In the liquid discharge recording apparatus 1, the ink-jet head 4 may further have a nozzle and a supply port for a treatment solution. The liquid discharge recording apparatus 1 may further have a cartridge in which the treatment solution is stored and a tube for supplying the treatment solution.

When the liquid is recovered in this example, the ink-jet head 4 is stopped, without scanning in the scanning direction, and the ink(s) discharged from the nozzles 16 is/are discharged immediately downwardly. FIG. 2 shows an example wherein liquid recovery for recovering the black ink from the nozzle 16*bk* and liquid recovery for recovering the three color inks that are yellow, cyan and magenta inks from the nozzles 16*y*, 16*c* and 16*m* are performed at the same time.

In FIG. 2, the liquids are recovered by discharging the inks of the respective colors that are the black ink and the yellow, cyan and magenta inks from the nozzle 16*bk* of the black ink and the nozzles 16*y*, 16*c* and 16*m* of the three color inks onto the first flushing absorber 53 accommodated in the waste liquid tank 50 and the second flushing absorber 54 accommodated in the liquid receiving member 51, respectively, at a position at which the nozzle 16*bk* of the black ink is made to face or to be opposite to the first flushing absorber 53, and at which the nozzles 16*y*, 16*c* and 16*m* of the three color inks are made to face the second flushing absorber 54. Note that the liquid recovery of the liquid from the nozzle 16*bk* of the black ink and the liquid recovery of the liquids from the nozzles 16*y*, 16*m*, and 16*c* of the three color inks may be performed separately from each other. Further, in a case that the ink-jet head 4 has the nozzle for the treatment solution, liquid recovery of the liquid from the nozzle for the treatment solution can also be performed by moving the nozzle for the treatment solution to a position facing or to be opposite to the first or second flushing absorber 53 or 54, in a similar manner as for the recovery of the inks.

The unsaturated fatty acid of which specific gravity is smaller than that of the liquid(s) is contained in the first and second flushing absorbers 53 and 54. Therefore, it is possible to lower the volatilization of the VOC contained in the liquid(s) by capping or covering the liquid(s), permeated into the first and second flushing absorbers 53 and 54, with the oil film of the unsaturated fatty acid. Further, since the liquid(s) of which specific gravity is/are greater than the specific gravity of the unsaturated fatty acid permeate(s) below the unsaturated fatty acid in the second flushing absorber 54, any accumulation of the liquid(s) is suppressed on (in) the surface of the second flushing absorber 54, suppressing any mixing of the liquid(s) in the liquid discharge surface 4*a* of the ink-jet head 4, any clogging of the liquid discharge head 4, and any staining (contamination) of the recording paper P.

Next, another example of the liquid recovery method of the first embodiment will be explained with reference to FIG. 1. As described above, in the liquid discharge recording apparatus 1 shown in FIG. 1, the liquid sucked and discharged by the suction purge is absorbed by the waste liquid absorber 22 via the suction pump 23. Since the waste liquid absorber 22 also contains the unsaturated fatty acid of which specific gravity is smaller than that of the liquid, it is possible to lower the volatilization of the VOC contained in the liquid permeated into the waste liquid absorber 22 by capping or covering the liquid with the oil film of the unsaturated fatty acid.

In this embodiment, each of the first flushing absorber 53, the second flushing absorber 54 and the waste liquid absorber 22 in FIG. 1 is the "absorber configured to absorb the liquid discharged from the liquid discharge head" of the first embodiment. However, the absorber of the first embodiment is not limited to that explained regarding this embodiment. For example, a flushing absorber may be provided on the platen 2. By providing the flushing absorber on the platen 2, it is possible to shorten the moving distance and moving time of the ink-jet head 4 between the flushing period during which the flushing operation is performed and the recording period during which the recording operation is performed. Further, a platen absorber may be arranged on the platen 2 at a portion in which an end or edge portion of the recording medium (recording paper) P passes. In case of performing a borderless recording with respect to the recording paper P, it is possible to absorb, with the platen absorber, an ink (liquid) discharged onto the platen beyond the end portion of the recording paper P. By allowing the platen absorber to contain the unsaturated fatty acid of which specific gravity is smaller than that of the liquid, it is possible to reduce the volatilization of the VOC contained in the liquid.

According to the present teaching, it is possible to lower the volatilization of the VOC contained in the liquid discharged from the liquid discharge head, by causing the absorber, containing the unsaturated fatty acid of which specific gravity is smaller than that of the liquid, to absorb the liquid discharged from the liquid discharge head.

Second Embodiment

Next, an explanation will be given about, as a second embodiment of the present teaching, a liquid discharge recording apparatus wherein the absorber has an upper layer containing the unsaturated fatty acid and a lower layer containing a hydrophilic solvent. The liquid discharge recording apparatus of the second embodiment can be made similar to the liquid discharge recording apparatus of the first embodiment, except the point that the absorber has the upper layer containing the unsaturated fatty acid and the lower layer containing the hydrophilic solvent.

The second embodiment of the present teaching is based on the following two concepts. The first concept is, similar to the above-described first embodiment, to lower the volatilization of the VOC contained in the liquid by allowing the liquid of which specific gravity is greater than that of the unsaturated fatty acid to permeate below the upper layer of the absorber to thereby cover or cap the liquid, permeated below the upper layer, with an oil film of the unsaturated fatty acid. The second concept is to further lower the volatilization of the VOC contained in the liquid by allowing the liquid, which has been permeated below the upper layer of the absorber, to be dissolved in the hydrophilic solvent in the lower layer of the absorber. The inventors of the present teaching were the first to obtain these first and second concepts. Base on these concepts, the inventors of the present teaching found out that the volatilization of the VOC contained in the liquid can be actually lowered by discharging the liquid from the liquid discharge head onto the absorber having a two-layer structure wherein the upper layer contains the unsaturated fatty acid of which specific gravity is smaller than that of the liquid and the lower layer contains the hydrophilic solvent. Thus, according to the second embodiment, it is possible to provide a liquid discharge recording apparatus and a liquid recovery method which are capable of lowering the volatilization of VOC. Further, according to the second embodiment, the liquid of which specific gravity is greater than the specific gravity of the unsaturated fatty acid permeates below the upper layer of the absorber, and is dissolved in the hydrophilic solvent in the lower layer of the absorber. Therefore, it is possible to suppress any accumulation of the liquid on the surface of the absorber, thereby making it possible to obtain secondary effect of suppressing any mixing of the liquid(s) in a liquid discharge surface of a liquid discharge head (which will be described later on), suppressing any clogging of the liquid discharge head, and suppressing any staining (contamination) of a recording medium such as recording paper (recording sheet), etc.

The absorber of the second embodiment may include another layer, in a range not adversely affecting the effect of the second embodiment, provided that the absorber includes the upper layer containing the unsaturated fatty acid and the lower layer containing the hydrophilic solvent. However, it is preferable that the absorber has the two-layer structure constructed of the upper and lower layers as described above.

The absorber having the above-described upper and lower layers of the second embodiment may be two absorbers which are separable from each other. In such a case, the absorber of the second embodiment is configured such that an upper layer-absorber containing the unsaturated fatty acid is stacked on a lower layer-absorber containing the hydrophilic solvent. Further, the absorber in the second embodiment may be configured such that the two layers that are upper and lower layers are formed in one absorber. In such a case, the upper layer containing the unsaturated fatty acid is formed in an upper portion of the absorber, and the lower layer containing the hydrophilic solvent is formed on a lower portion of the same absorber. It is preferable that the hydrophilic solvent has a specific gravity greater than that of the unsaturated fatty acid, so that the position of the unsaturated fatty acid in the upper portion and the position of the hydrophilic solvent in the lower layer are hardly reversed within the absorber.

In the liquid discharge recording apparatus of the second embodiment, the unsaturated fatty acid may be similar to or same as the unsaturated acid in the first embodiment.

In the liquid discharge recording apparatus of the second embodiment, the hydrophilic solvent can function, for example, to suppress any accumulation of an ink component volatilized and solidified on the surface of the absorber. The hydrophilic solvent is not particularly limited, and includes, for example, water, a humectant, a penetrant, a surfactant, etc. The humectant is not particularly limited, and includes, for example, lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahydrofuran and dioxane; polyethers such as polyalkylene glycol; polyhydric alcohols such as alkylene glycol, glycerol and trimethylolpropane; 2-pyrrolidone; N-methyl-2-pyrrolidone; and 1,3-dimethyl-2-imidazolidinone. The polyalkylene glycol includes, for example, polyethylene glycol, polypropylene glycol, etc. The alkylene glycol includes, for example, ethylene glycol, propylene glycol, butylene glycol, diethylene glycol, triethylene glycol, dipropylene glycol, tripropylene glycol, thiodiglycol, hexylene glycol, etc. The penetrant is not particularly limited, and includes, for example, ethylene glycol methyl ether, ethylene glycol ethyl ether, ethylene glycol n-propyl ether, diethylene glycol methyl ether, diethylene glycol ethyl ether, diethylene glycol n-propyl ether, diethylene glycol n-butyl ether, triethylene glycol methyl ether, triethylene glycol ethyl ether, triethylene glycol n-propyl ether, triethylene glycol n-butyl ether, propylene glycol methyl ether, propylene glycol ethyl ether, propylene glycol n-propyl ether, propylene glycol n-butyl ether, dipropylene glycol methyl ether, dipropylene glycol ethyl ether, dipropylene glycol n-propyl ether, dipropylene glycol n-butyl ether, tripropylene glycol methyl ether, tripropylene glycol ethyl ether, tripropylene glycol n-butyl ether, tetraethylene glycol n-butyl ether, etc. Among those described above, it is preferable to use the penetrant in view of aiding the penetration of the liquid. Among these substances described above, water, polyhydric alcohols such as glycerol, and glycol ether are preferable; and water, glycerol, triethylene glycol, diethylene glycol and triethylene glycol butyl ether are particularly preferable. One type (kind) of the hydrophilic solvent may be used singly, or two or more types (kinds) of the hydrophilic solvents may be used in combination. Further, in view of the cost, a penetrant, as the hydrophilic solvent, which is same as the penetrant contained in the liquid is preferably used.

In the second embodiment, it is preferable that the unsaturated fatty acid is oleic acid, and the hydrophilic solvent is water. Further, it is preferable that the unsaturated fatty acid is linoleic acid and that the hydrophilic solvent is glycerol. In a case that the unsaturated fatty acid contained in the upper layer and the hydrophilic solvent contained in the lower layer are the above-described combination, the volatilization of the VOC can be lowered to a greater extent.

In the second embodiment, the amount of the unsaturated fatty acid contained per 1 $mm^3$ of the absorber ($\mu g/mm^3$) and the amount of the unsaturated fatty acid contained in the absorber (g) can be same as those in the first embodiment. In view of preventing the liquid from dripping or leaking from the absorber, the amount of the hydrophilic solvent contained per 1 $mm^3$ of the absorber is preferably is not more than 0.91 $\mu g/mm^3$, and is more preferably not more than 0.7 $\mu g/mm^3$. Further, in view of sufficiently suppressing the volatilization of the liquid, the amount of the hydrophilic solvent contained per 1 $mm^3$ of the absorber is preferably not less than 0.1 $\mu g/mm^3$, and is more preferably not less than 0.2 $\mu g/mm^3$. Furthermore, the amount of the hydrophilic solvent contained in the absorber may be determined depending on, for example, the period of service life or lifetime of the liquid discharge recording apparatus, etc. For example, in a case that the absorber is a flushing absorber (to be described later on) of the liquid discharge recording apparatus, the amount of the hydrophilic solvent contained in the flushing absorber is preferably not less than 0.10 g, is more preferably not less than 0.18 g, is preferably not more than 0.81 g, and is more preferably not more than 0.63 g.

In the liquid discharge recording apparatus of the second embodiment, the liquid may be similar to or same as the liquid in the first embodiment. Further, in view of the cost, the liquid preferably contains a hydrophilic solvent which is same as the hydrophilic solvent contained in the lower layer of the absorber is preferably used.

Next, a liquid discharge recording apparatus and a liquid recovery method of the second embodiment will be specifically explained. The liquid discharge recording apparatus of the second embodiment includes a liquid discharge head which discharges a liquid and an absorber which absorbs the liquid discharged from the liquid discharge head. The absorber is preferably at least one of a flushing absorber and a waste liquid absorber. In the liquid discharge recording apparatus of the second embodiment, the configuration of the liquid discharge recording apparatus, except for the absorber, may be similar to that of a liquid discharge recording apparatus of the first embodiment such as an ink-jet recording apparatus. The liquid recovery method of the second embodiment is practiced by using the liquid discharge recording apparatus of the second embodiment.

Figure 3:
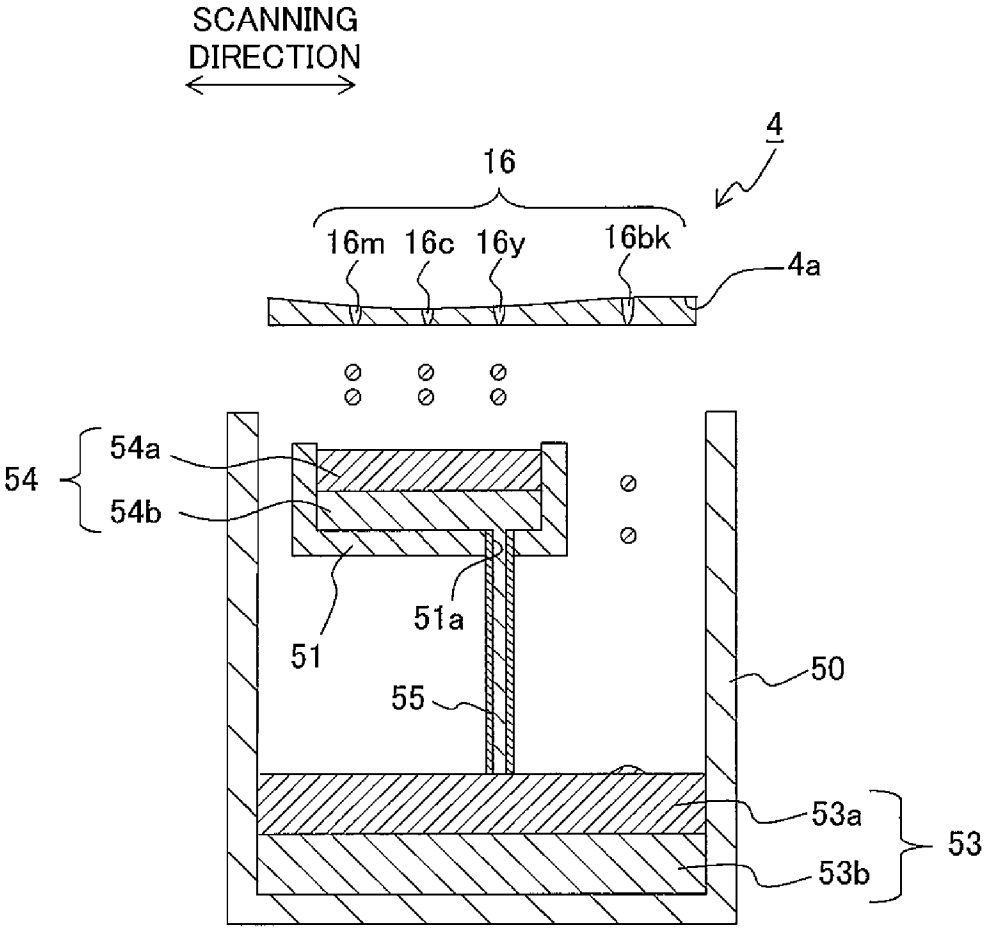
FIG. 3 is a cross-sectional view of a waste liquid tank in the vertical plane including the scanning direction when the liquid discharge recording apparatus of the second embodiment, which is shown in FIG. 1, performs liquid recovery operation.

FIGS. 1 and 3 show the configuration of an example of the liquid discharge recording apparatus of the second embodiment. A liquid discharge recording apparatus 1 of the second embodiment has a configuration that is similar to that of the liquid discharge recording apparatus explained regarding the first embodiment, except that a waste liquid absorber 22, a first flushing absorber 53 and a second flushing absorber 54 are each have a two-layered structure wherein each of the waste liquid absorber 22, the first flushing absorber 53 (53*a*, 53*b*) and the second flushing absorber 54 (54*a*, 54*b*) are divided or separated as upper and lower layers in the gravity direction. Accordingly, any explanation of the parts or components which are different from the waste liquid absorber 22, the first flushing absorber 53 and the second flushing absorber 54 are omitted.

Although not shown in the drawings, the waste liquid absorber 22 has a two-layered structure in which the waste liquid absorber 22 is divided or separated into upper and lower layers in the gravity direction, and is accommodated in a box which is open at an upper portion of the box. The waste liquid absorber 22 may be any member provided that such a member is capable of absorbing a liquid, such as, for example, a stacked member constructed of two layers of a melamine foam which are stacked on each other, etc.

As shown in FIG. 3, the waste liquid tank 50 has a box-shape which is open at an upper portion thereof, and accommodates the first flushing absorber 53 inside of the waste liquid tank 50. The first flushing absorber 53 has a two-layered structure constructed of an upper layer 53*a* and a lower layer 53*b*. A liquid receiving member 51 is arranged at a position above or over the first flushing absorber 53. The liquid receiving member 51 has a box-shape which is open at an upper portion thereof, and accommodates the second flushing absorber 54 inside of the liquid receiving member 51. The second flushing absorber 54 has a two-layered structure constructed of an upper layer 54*a* and a lower layer 54*b*. Each of the first flushing member 53 and the second flushing member 54 may be any member provided that such a member is capable of absorbing a liquid, such as, for example, a stacked member constructed of two layers of a melamine foam which are stacked on each other, etc.

Each of the upper layers of the first flushing absorber 53, the second flushing absorber 54 and the waste liquid absorber 22 contains the unsaturated fatty acid of which specific gravity is smaller than that of the liquid, and each of the lower layers of the first flushing absorber 53, the second flushing absorber 54 and the waste liquid absorber 22 contain the hydrophilic solvent. In each of the first and second flushing absorbers 53 and 54, the unsaturated fatty acid and the hydrophilic solvent may be contained only at a portion which makes contact with the liquid discharged from the ink-jet head 4, or may be contained in the entirety of each of the first and second flushing absorbers 53 and 54.

Next, an example of the liquid recovery method of the second embodiment will be explained with reference to FIG. 3. This example is a liquid recovery method wherein the liquid from the ink-jet head 4 is recovered by discharging the liquid from the ink-jet head 4 directly to the flushing absorber. FIG. 3 is a cross-sectional view of the waste liquid tank 50 in a vertical plane including the scanning direction when the liquid discharge recording apparatus 1 shown in FIG. 1 performs a liquid recovery operation.

When the liquid is recovered in this example, the ink-jet head 4 is stopped, without scanning in the scanning direction, and the ink(s) discharged from the nozzles 16 is/are discharged immediately downwardly. FIG. 3 shows an example wherein liquid recovery for recovering the black ink from the nozzle 16*bk* and liquid recovery for recovering the three color inks that are yellow, cyan and magenta inks from the nozzles 16*y*, 16*c* and 16*m* are performed at the same time.

In FIG. 3, the liquids are recovered by discharging the inks of the respective colors that are the black ink and the yellow, cyan and magenta inks from the nozzle 16*bk* of the black ink and the nozzles 16*y*, 16*c* and 16*m* of the three color inks toward the first flushing absorber 53 accommodated in the waste liquid tank 50 and the second flushing absorber 54 accommodated in the liquid receiving member 51, respectively, at a position at which the nozzle 16*bk* of the black ink is made to face or to be opposite to the first flushing absorber 53, and at which the nozzles 16*y*, 16*c* and 16*m* of the three color inks are made to face the second flushing absorber 54.

The upper layer 53*a* of the first flushing absorber 53 and the upper layer 54*a* of the second flushing absorber 54 each contain the unsaturated fatty acid of which specific gravity is smaller than that of the liquids. Accordingly, the liquids having the specific gravity greater than that of the unsaturated fatty acid permeate below the upper layer 53*a* and the upper layer 54*a*, and are capped or covered by the oil film of the unsaturated fatty acid, thereby lowering the volatilization of the VOC contained in the liquids. Further, the liquids, which have been permeated below the upper layers 53*a* and 54*a* of the first and second absorbers 53 and 54, respectively, are dissolved in the hydrophilic solvent in the lower layers 53*b* and 54*b* of the first and second absorber 53 and 54, respectively, thereby further lowering the volatilization of the VOC contained in the liquids. Furthermore, as described above, the liquids having the specific gravity greater than that of the unsaturated fatty acid permeate below the upper layer 54*a* of the second flushing absorber 54 and are dissolved in the hydrophilic solvent in the lower layer 54*a*, thereby suppressing any accumulation of the liquid(s) on the surface of the second flushing absorber 54, and thereby suppressing any mixing of the liquid(s) in the liquid discharge surface 4*a* of the ink-jet head 4, any clogging of the liquid discharge head 4, and any staining (contamination) of the recording paper P.

Next, an explanation will be given about another example of the liquid recovery method of the second embodiment. As described above, in the liquid discharge recording apparatus 1 shown in FIG. 1, the liquid forcibly discharged by the suction purge is absorbed by the waster liquid absorber 22 via the suction pump 23. The unsaturated fatty acid of which specific gravity is smaller than that of the liquid is contained in the upper layer of the waste liquid absorber 22, and the hydrophilic solvent is contained in the lower layer of the waste liquid absorber 22. Therefore, the liquid of which specific gravity is greater than that of the unsaturated fatty acid permeates below the upper layer of the waste liquid absorber 22 and is capped or covered by the oil film of the unsaturated fatty acid, thereby lowering the volatilization of the VOC contained in the liquid. Further, the liquid, which has been permeated below the upper layer of the waste liquid absorber 22, is dissolved in the hydrophilic solvent in the lower layer of the waste liquid absorber 22, thereby further lowering the volatilization of the VOC contained in the liquid. As described above, the second embodiment is applicable to not only a case wherein the liquid discharged from the ink-jet head 4 is directly absorbed but also to an aspect wherein the liquid is absorbed by the waste liquid absorber 22 via the suction pump 23.

As explained above, according to the second embodiment, it is possible to suppress the volatilization of the VOC contained in the liquid by allowing the liquid, discharged from the liquid discharge head, to be absorbed by the absorber having the two-layered structure wherein the upper layer contains the unsaturated fatty acid of which specific gravity is smaller than that of the liquid, and the lower layer contains the hydrophilic solvent.

EXAMPLES

Next, examples of the present teaching will be explained together with comparative examples. Note that the present teaching is not limited and is not restricted to the examples and the comparative examples which will be described below.

Examples 1-6 and Comparative Examples 1-5

A melamine foam (surface area: 1 $cm^2$, thickness: 5 mm) was placed in a vial bottle for HS-GC/MS (Head Space-Gas Chromatography/Mass Spectrometry) measurement. Next, 100 μL of an ink was permeated into the melamine foam and was kept to have a temperature of 60 degrees Celsius for 30 minutes. As the ink, each of three kinds of inks having compositions shown in TABLE 2 as follows was used. After the temperature keeping, the gas was poured or supplied from the vial bottle to the GS/MS for 0.05 minutes and the measurement was performed. Thus, the total of the peak areas of the VOC contained in the inks were calculated. Further, a melamine foam was placed in a vial bottle for the HS-GC/MS measurement. Next, 100 μL of each of unsaturated fatty acids as measurement objectives (saturated fatty acid in Comparative Example 1, hydrophilic solvent in each of Comparative Examples 3 to 5) was permeated into the melamine foam, and then the total of the peak areas of the VOC contained in the inks were calculated, in a similar manner as described above. In Example 6, 25 μL of lipophilic solvent (ethylene glycol diacetate) was made to permeate into the melamine foam, in addition to 100 μL of the unsaturated fatty acid (oleic acid) as the measurement objective. Further, the reduction rate of the VOC contained in the ink was calculated for each of the examples and the comparative example by the following formula, and evaluation was made based on the following evaluation criterion. With such a model experiment, the degree of suppressing the volatilization by the combination of the ink and the unsaturated fatty acid permeated in the melamine foam was confirmed.

$$\text{Reduction Rate (\%)}=\{(X-Y)/X\}\times 100$$

X: Total of the peak areas in the ink itself

Y: Total of the peak areas in a case that the unsaturated fatty acid as the measurement objective was permeated in the melamine foam <Evaluation Criterion>

AA: The reduction rate was not less than 75%.

A: The reduction rate was not less than 25% to less than 75%.

B: The reduction rate was not less than 10% to less than 25%.

C: The reduction rate was less than 10%.

TABLE 1

| | | INKS | | |
|---|---|---|---|---|
| | | Ink 1 | Ink 2 | Ink 3 |
| Composition of Water-based Ink (% by weight) | CAB-O-JET (trade name) 300 (*1) | 60.0 | 40.0 | — |
| | C.I. Acid Blue 90 | — | — | 4.0 |
| | Glycerol | 3.5 | 40.0 | — |
| | Triethylene glycol | 4.0 | — | — |
| | Diethylene glycol | 8.0 | — | — |
| | Dipropylene glycol n-propyl ether | 2.5 | 2.5 | 2.5 |
| | Isopropyl alcohol | — | — | 40.0 |
| | Water | balance | balance | balance |

(*1): Self-dispersible carbon black, produced by Cabot Specialty Chemicals, carbon black concentration = 15% by weight.

The results of measurement of Examples 1-6 are shown in TABLE 2 and the results of measurement of Comparative Examples 1-5 are shown in TABLE 3 as follows.

TABLE 2

| | | EXAMPLES | | | | | |
|---|---|---|---|---|---|---|---|
| | | EX. 1 | EX. 2 | EX. 3 | EX. 4 | EX. 5 | EX. 6 |
| Melamine foam | Unsaturated fatty acid | erucic acid | oleic acid | linoleic acid | linoleic acid | arachidonic acid | oleic acid |
| | Degree of unsaturation | 1 | 1 | 2 | 3 | 4 | 1 |
| | Specific gravity | 0.860 | 0.898 | 0.902 | 0.914 | 0.919 | 0.898 |
| | Lipophilic solvent | — | — | — | — | — | ethylene glycol diacetate |
| Ink | Specific Gravity | Ink 1 1.070 | Ink 1 1.070 | Ink 1 1.070 | Ink 1 1.070 | Ink 1 1.070 | Ink 1 1.070 |
| Reduction rate (%) | | A | A | A | A | B | B |

TABLE 3

| | | COMPARATIVE EXAMPLES | | | | |
|---|---|---|---|---|---|---|
| | | COM. EX. 1 | COM. EX. 2 | COM. EX. 3 | COM. EX. 4 | COM. EX 5 |
| Melamine foam | Unsaturated fatty acid, etc. | stearic acid | erucic acid | glycerol | isopropyl alcohol | diethyelen glycol |
| | Degree of unsaturation | 0 | 1 | — | — | — |
| | Specific gravity | 0.940 | 0.860 | 1.264 | 0.785 | 1.116 |
| | Lipophilic solvent | — | — | — | — | — |
| Ink | Specific Gravity | Ink 1 1.070 | Ink 3 0.830 | Ink 1 1.070 | Ink 1 1.070 | Ink 2 1.130 |
| Reduction rate (%) | | C | C | C | C | C |

As shown in TABLE 2, the volatilization of the VOC contained in the ink was lowered in Examples 1 to 6. Further, in a case that the melamine foam in Examples 1 to 6 was used as the second flushing absorber 54 in the liquid discharge recording apparatus 1 as shown in FIG. 1, it was confirmed that the accumulation of the inks, which were used in Examples 1 to 6, on the surface of the second flushing absorber 54 was suppressed. In each of Examples 1 to 4 wherein the unsaturated fatty acid of which degree of unsaturation was in a range of 1 to 3 and of which the specific gravity was in a range of 0.850 to 0.915 was contained in the melamine foam, the effect of lowering the volatilization of the VOC and the effect of suppressing the accumulation of the ink were further enhanced.

On the other hand, as shown in TABLE 3, the VOC contained in the ink was volatilized in each of Comparative Examples 1 and 3-5 wherein the saturated fatty acid or the hydrophilic solvent was contained in the melamine foam, rather than the unsaturated fatty acid. Further, the VOC contained in the ink volatilized also in Comparative Example 2 wherein the unsaturated fatty acid of which specific gravity was greater than that of the ink was contained in the melamine foam. Furthermore, in a case that the melamine foam used in Comparative Examples 1 to 5 was used as the second flushing absorber 54 in the ink-jet recording apparatus 1 shown in FIG. 1, the inks used in Comparative Examples 1 to 5 were accumulated on the surface of the second flushing absorber 54.

Examples 7-11 and Comparative Examples 6-10

A stacked member of melamine foam with two-layered structure having upper and lower layers (surface area of each layer: 1 $cm^2$, thickness: 5 mm) was placed in a vial bottle for HS-GC/MS (Head Space-Gas Chromatography/Mass Spectrometry) measurement. Next, 100 μL of an ink was permeated into the stacked member of melamine foam and was kept to have a temperature of 60 degrees Celsius for 30 minutes. As the ink, each of three kinds of inks having compositions shown in TABLE 1 as follows was used. After the temperature keeping, the gas was poured or supplied from the vial bottle to the GS/MS for 0.05 minutes and the measurement was performed. Thus, the total of the peak areas of the VOC contained in the inks were calculated. Further, a stacked member of melamine foam having the two-layered structure was placed in a vial bottle for the HS-GC/MS measurement. Next, 100 μL of each of unsaturated fatty acids as measurement objectives (saturated fatty acid in Comparative Example 6, hydrophilic solvent in each of Comparative Examples 8 to 10) was permeated into the upper layer of the stacked member of melamine foam, and 100 μL of each of hydrophilic solvents as measurement objectives was permeated into the lower layer of the stacked member of melamine foam; and then the total of the peak areas of the VOC contained in the inks were calculated, in a similar manner as described above. Further, the reduction rate of the VOC contained in the ink was calculated for each of the examples and the comparative example by the following formula, and evaluation was made based on the following evaluation criterion. With such a model experiment, the degree of suppressing the volatilization by the combination of the ink and the unsaturated fatty acid and hydrophilic solvent permeated in the stacked member of melamine foam having the two-layered structure was confirmed.

$$\text{Reduction Rate (\%)}=\{(X-Y)/X\}\times 100$$

X: Total of the peak areas in the ink itself

Y: Total of the peak areas in a case that the unsaturated fatty acid and the hydrophilic solvent as the measurement objectives were permeated in the stacked member of melamine foam having the two-layered structure <Evaluation Criterion>

AA: The reduction rate was not less than 75%.

A: The reduction rate was not less than 25% to less than 75%.

B: The reduction rate was not less than 10% to less than 25%.

C: The reduction rate was less than 10%.

The results of measurement of Examples 7-11 are shown in TABLE 4 and the results of measurement of Comparative Examples 6-10 are shown in TABLE 5 as follows.

TABLE 4

| | | | EXAMPLES | | | | |
|---|---|---|---|---|---|---|---|
| | | | EX. 7 | EX. 8 | EX. 9 | EX. 10 | EX. 11 |
| Stacked member of Melamine foam with two-layered structure | Upper layer | unsaturated fatty acid | erucic acid | oleic acid | linoleic acid | linolenic acid | arachidonic acid |
| | | Degree of unsaturation | 1 | 1 | 2 | 3 | 4 |
| | | Specific gravity | 0.860 | 0.898 | 0.902 | 0.914 | 0.919 |
| | lower layer | hydrophilic solvent | triethylene glycol | water | glycerol | diethylene glycol | triethylene glycol butyl ether |
| | | Specific gravity | 1.12 | 1.0 | 1.264 | 1.116 | 0.985 |
| Ink | | Specific Gravity | Ink 1 1.070 | Ink 1 1.070 | Ink 1 1.070 | Ink 1 1.070 | Ink 1 1.070 |
| Reduction rate (%) | | | AA | AA | AA | AA | A |

TABLE 5

| | | | COMPARATIVE EXAMPLES | | | | |
|---|---|---|---|---|---|---|---|
| | | | COM. EX. 6 | COM. EX. 7 | COM. EX. 8 | COM. EX. 9 | COM. EX. 10 |
| Stacked member of Melamine foam with two-layered structure | Upper layer | Acid or solvent | stearic acid | erucic acid | glycerol | isopropyl alcohol | diethylene glycol |
| | | Degree of unsaturation | 0 | 1 | — | — | — |
| | | Specific gravity | 0.940 | 0.860 | 1.264 | 0.785 | 1.116 |
| | lower layer | solvent | triethylene glycol | triethylene glycol | glycerol | isopropyl alcohol | diethylene glycol |
| | | Specific gravity | 1.12 | 1.12 | 1.264 | 0.785 | 1.116 |
| Ink | | Specific Gravity | Ink 1 1.070 | Ink 3 0.830 | Ink 1 1.070 | Ink 1 1.070 | Ink 2 1.130 |
| Reduction rate (%) | | | C | C | C | C | C |

As shown in Table 4, the volatilization of the VOC contained in the ink was lowered in Examples 7 to 11. Further, in a case that the stacked member of melamine foam with the two-layered structure in Examples 7 to 11 was used as the second flushing absorber 54 in the liquid discharge recording apparatus 1 as shown in FIG. 1, it was confirmed that the accumulation of the inks, which were used in Examples 7 to 11, on the surface of the second flushing absorber 54 was suppressed. In each of Examples 7 to 10 wherein the unsaturated fatty acid of which degree of unsaturation was in a range of 1 to 3 and of which the specific gravity was in a range of 0.850 to 0.915 was contained in upper layer of the stacked member of melamine foam with the two-layered structure, the effect of lowering the volatilization of the VOC and the effect of suppressing the accumulation of the ink were further enhanced.

On the other hand, as shown in Table 5, the VOC contained in the ink was volatilized in each of Comparative Examples 6 and 8-10 wherein the saturated fatty acid or the hydrophilic solvent was contained in the upper layer of the stacked member of melamine foam with the two-layered structure, rather than the unsaturated fatty acid. Furthermore, the VOC contained in the ink was volatilized in Comparative Example 7 wherein unsaturated fatty acid of which specific gravity is greater than that of the ink was contained in the upper layer of the stacked member of melamine foam with the two-layered structure, rather than the unsaturated fatty acid of which specific gravity is smaller than that of the ink. Moreover, in a case that the stacked member of melamine foam with the two-layered structure used in Comparative Examples 6 to 10 was used as the second flushing absorber 54 in the ink-jet recording apparatus 1 shown in FIG. 1, the inks used in Comparative Examples 6 to 10 were accumulated on the surface of the second flushing absorber 54.

As described above, the liquid discharge recording apparatus of the present teaching is capable of lowering the generation of VOC. The usage of the liquid discharge recording apparatus of the present teaching is not particularly limited, and is widely applicable to a variety of kinds of ink-jet recording.

What is claimed is:

1. A liquid discharge recording apparatus comprising:

a liquid;

a liquid discharge head configured to discharge the liquid;

an absorber configured to absorb the liquid discharged from the liquid discharge head; and unsaturated fatty acid of which specific gravity is smaller than that of the liquid and which is contained in the absorber, wherein the unsaturated fatty acid is an aliphatic monocarboxylic acid having a chain of 12 to 22 carbon atoms.

2. The liquid discharge recording apparatus according to claim 1, wherein degree of unsaturation of the unsaturated fatty acid is 1 to 3.

3. The liquid discharge recording apparatus according to claim 1, wherein the unsaturated fatty acid is at least one selected from the group consisting of erucic acid, oleic acid, linoleic acid, linolenic acid and arachidonic acid.

4. The liquid discharge recording apparatus according to claim 1, wherein an amount of the unsaturated fatty acid contained per 1 $mm^3$ of the absorber is 0.1 $\mu g/mm^3$ to 0.91 $\mu g/mm^3$.

5. The liquid discharge recording apparatus of claim 1, wherein the unsaturated fatty acid is an aliphatic monocarboxylic acid having 18 to 22 carbon atoms.

6. The liquid discharge recording apparatus according to claim 1, wherein the absorber is a flushing absorber which faces the liquid discharge head and is configured to receive the liquid discharged from the liquid discharge head.

7. The liquid discharge recording apparatus according to claim 6, wherein an amount of the unsaturated fatty acid contained in the flushing absorber is 0.10 g to 0.81 g.

8. The liquid discharge recording apparatus according to claim 1, wherein the liquid is a water-based ink.

9. The liquid discharge recording apparatus according to claim 8, wherein the water-based ink contains a pigment.

10. The liquid discharge recording apparatus according to claim 9, wherein the water-based ink contains at least one selected from the group consisting of glycerol, triethylene glycol, diethylene glycol and dipropylene glycol n-propyl ether and the unsaturated fatty acid is at least one selected from the group consisting of erucic acid, oleic acid, linoleic acid, linolenic acid and arachidonic acid.

11. The liquid discharge recording apparatus according to claim 9, wherein difference between specific gravity of the water-based ink and that of the unsaturated fatty acid is 0.151 to 0.21.

12. The liquid discharge recording apparatus according to claim 1, wherein the absorber has an upper layer containing the unsaturated fatty acid and a lower layer containing a hydrophilic solvent.

13. The liquid discharge recording apparatus according to claim 12, wherein the absorber has a two-layered structure constructed of the upper and lower layers.

14. The liquid discharge recording apparatus according to claim 12, wherein the hydrophilic solvent has a specific gravity greater than that of the unsaturated fatty acid.

15. The liquid discharge recording apparatus according to claim 12, wherein the hydrophilic solvent is at least one selected from the group consisting of water, polyhydric alcohol and glycol ether.

16. The liquid discharge recording apparatus according to claim 12, wherein the hydrophilic solvent is at least one selected from the group consisting of water, glycerol, triethylene glycol, diethylene glycol and triethylene glycol butyl ether.

17. The liquid discharge recording apparatus according to claim 12, wherein the unsaturated fatty acid is oleic acid, and the hydrophilic solvent is water.

18. The liquid discharge recording apparatus according to claim 12, wherein the unsaturated fatty acid is linoleic acid, and the hydrophilic solvent is glycerol.

19. The liquid discharge recording apparatus according to claim 12, wherein the liquid includes a hydrophilic solvent which is same as the hydrophilic solvent contained in the lower layer of the absorber.

20. The liquid discharge recording apparatus according to claim 12, wherein the absorber is a flushing absorber of which the upper layer faces the liquid discharge head and is configured to receive the liquid discharged from the liquid discharge head.

21. A liquid-recovery method for recovering a liquid in a liquid discharge recording apparatus, the method comprising:

discharging the liquid from a liquid discharge head of the liquid discharge recording apparatus; and recovering the liquid, discharged from the liquid discharge head, by absorbing the liquid with an absorber containing unsaturated fatty acid of which specific gravity is smaller than that of the liquid, wherein the unsaturated fatty acid is an aliphatic monocarboxylic acid having a chain of 12 to 22 carbon atoms.

* * * * *